US007421234B2

(12) United States Patent
Ikeda et al.

(10) Patent No.: US 7,421,234 B2
(45) Date of Patent: Sep. 2, 2008

(54) TONER CARTRIDGE WITH SHUTTER FOR A TONER SUPPLY PORT AND A MANUAL OPERATION LEVER TO CHANGE THE POSTURE OF THE SHUTTER

(75) Inventors: Masami Ikeda, Osaka (JP); Chisato Hatekeyama, Osaka (JP)

(73) Assignee: Kyocera Mita Corporation (JP)

( * ) Notice: Subject to any disclaimer, the term of this patent is extended or adjusted under 35 U.S.C. 154(b) by 284 days.

(21) Appl. No.: 11/343,173

(22) Filed: Jan. 30, 2006

(65) Prior Publication Data

US 2006/0171744 A1 Aug. 3, 2006

(30) Foreign Application Priority Data

Jan. 31, 2005 (JP) ..... 2005-023238

(51) Int. Cl.
*G03G 15/08* (2006.01)

(52) U.S. Cl. ..... 399/262

(58) Field of Classification Search ..... 399/258–262
See application file for complete search history.

(56) References Cited

U.S. PATENT DOCUMENTS

2004/0131391 A1* 7/2004 Nagashiro ..... 399/258

FOREIGN PATENT DOCUMENTS

JP 03002777 A * 1/1991
JP 2004-205587 7/2004

* cited by examiner

*Primary Examiner*—Ryan Gleitz
(74) *Attorney, Agent, or Firm*—Gerald E Hespos; Anthony J. Casella

(57) ABSTRACT

A toner cartridge (20) has a shutter (40) adapted to be changed between a closed posture (S1) and an open posture (S1) for opening a toner supply port (322), a lever (50) to be operated manually to change the posture of the shutter (40), and a postural-change restriction mechanism (60) for controlling a postural change of the shutter (40). The postural-change restriction mechanism (60) includes a lock groove (53) in the lever (50), and a restriction pawl (62) integrally formed with a cartridge body (30). The restriction pawl (62) engages the lock groove (53) when the lever (50) is operated to set the shutter (40) in the closed posture (S1), to block a postural change of the shutter (40), and to be elastically deformed when the cartridge body (30) is attached to a development device, in a manner to allow the postural change.

8 Claims, 9 Drawing Sheets

20
30
31
32
50
51
52
53
60
61
62
63
64

TONER CARTRIDGE WITH SHUTTER FOR A TONER SUPPLY PORT AND A MANUAL OPERATION LEVER TO CHANGE THE POSTURE OF THE SHUTTER

BACKGROUND OF THE INVENTION

1. Field of the Invention

The present invention relates to a toner cartridge adapted to be detachably attached to a development device of an image forming apparatus so as to supply toner to the development device.

2. Description of the Related Art

Heretofore, there has been known a toner cartridge for use in an image forming apparatus which is designed to form and output an image based on image information obtained through a read operation in a scanner device or transmitted from other apparatus. In the image forming apparatus, this toner cartridge serves as a means to supply toner to a development device for providing toner onto a peripheral surface of a photosensitive drum having an electrostatic latent image formed thereon in accordance with the image information, so as to form a toner image. The toner cartridge is designed to be detachably attached to the development device.

The toner cartridge includes a shutter member for openably closing a toner supply port formed in a bottom wall of a box-shaped cartridge body. Specifically, the toner cartridge is designed such that, when an operator manually opens the shutter member after attaching the toner cartridge to the development device, toner contained in the cartridge body is supplied to the development device through the toner supply port.

In this conventional toner cartridge, the shutter member is likely to be erroneously moved and opened before the toner cartridge is attached to the development device. This causes a problem about occurrence of contamination in the surrounding due to toner scattered outside through the toner supply port. Moreover, during an operation for replacing the toner cartridge, if the cartridge is detached from the development device without closing the shutter member, toner remaining in the cartridge body will be discharged outside to cause the same problem.

As measures against the above problem, a toner cartridge as disclosed in Japanese Patent Laid-Open Publication No. 2004-205587 has been proposed. This toner cartridge includes a lock mechanism for locking an open movement of the shutter member. Specifically, the lock mechanism is designed to allow the shutter member to be locked and kept from being opened when the toner cartridge is not attached to the development device, and to be opened when the toner cartridge is attached to the development device.

Thus, the toner cartridge disclosed in the Japanese Patent Laid-Open Publication No. 2004-205587 makes it possible to eliminate the risk that the shutter member is opened before the toner cartridge is attached to the development device and after it is detached from the development device, so as to reliably prevent the problem about occurrence of contamination in the surrounding due to toner scattered outside from the toner supply port.

In the toner cartridge disclosed in the Japanese Patent Laid-Open Publication No. 2004-205587, the shutter member and a manual operation lever for manually opening and closing the shutter member are connected to one another through a pair of gears formed in them, respectively. Thus, a structure for opening and closing the toner supply port becomes complicated. Moreover, the lock mechanism also has a complicated structure because a single-purpose member separated from the cartridge body is employed to construct the lock mechanism. These structures are likely to cause increases the number of components and man-hours of an assembling process generally more than ever before, resulting in sharp increase in production cost.

SUMMARY OF THE INVENTION

In view of the above problems, it is therefore an object of the present invention to provide a toner cartridge capable of reliably preventing toner leakage without increase in the number of components more than ever before, and contributing to reduction in production cost.

In order to achieve this object, a toner cartridge of the present invention comprises a cartridge body for supplying toner to a development device incorporated in an image forming apparatus, through a toner supply port, a shutter member adapted to be changed in posture between an open posture for opening the toner supply port and a closed posture for closing the toner supply port, a manual operation lever adapted to be manually operated so as to change the posture of the shutter member, and a postural-change restriction mechanism for restricting a postural change of the shutter member set in the closed posture to the open posture. The postural-change restriction mechanism includes a lock element formed in either one of the manual operation lever and the cartridge body, and a blocking element integral with the other one of the manual operation lever and the cartridge body. The blocking element is adapted to be engaged with the lock element when the manual operation lever is operated to set the shutter member in the closed posture, so as to block a postural change of the shutter member, and to be elastically deformed when the cartridge body is attached to the image forming apparatus, in such a manner as to be released from the engagement with the lock element to allow the postural change of the shutter member to the open posture.

According to the above toner cartridge, after the toner cartridge is attached to the development device, the manual operation lever is operated to change a posture of the shutter member from the closed posture to the open posture so as to open the toner supply port formed in a bottom of the cartridge body. Through this operation, toner contained in the cartridge body is supplied to the development device through the toner supply port.

When the toner cartridge is not attached to the development device, the blocking element is engaged with the lock element formed, for example, in the manual operation lever, to preclude the manual operation lever from being operated. Thus, even if an operator improperly attempts to operate the manual operation lever in either state before the toner cartridge is attached to the development device and after the toner cartridge is detached from the development device, the manual operation lever is never moved. This prevents occurrence of a problem about outside leakage of toner from the toner supply port due to a wrong operation of the manual operation lever.

Further, the blocking element adapted to be engaged with the manual operation lever so as to block the movement of the manual operation lever is integrally formed with the cartridge body. Thus, as compared with a toner cartridge employing a separate component as the blocking member as in the conventional manner, the toner cartridge of the present invention makes it possible to facilitate reduction in the number of components and man-hours of an assembling process so as to contribute to reduction in production cost of the toner cartridge.

Alternatively, the lock element may be formed in the cartridge body, and the blocking element may be integrally formed with the manual operation lever. In this case, the above effect can also be obtained.

BRIEF DESCRIPTION OF DRAWINGS

FIG. 6 is an explanatory partially cut-cut skeletal perspective view showing respective movements of a shutter member, a manual operation lever and a postural-change restriction mechanism, wherein

FIG. 8 is explanatory fragmentary side view showing an operation of the postural-change restriction mechanism of the toner cartridge, wherein

DETAILED DESCRIPTION OF THE PREFERRED EMBODIMENTS

Figure 1:
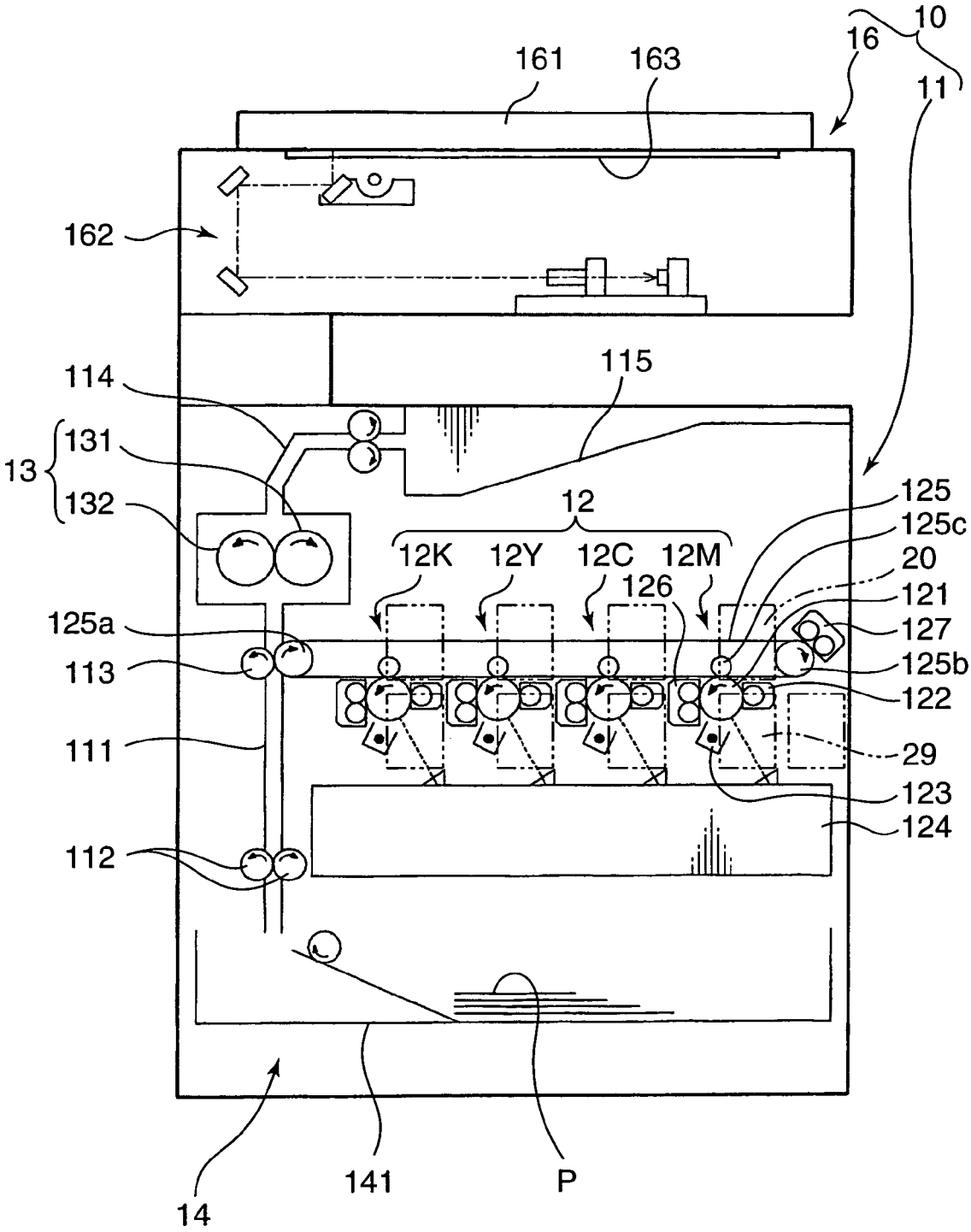
FIG. 1 is an explanatory sectional front view showing one example of an internal structure of an image forming apparatus employing a toner cartridge according to one embodiment of the present invention.

Firstly, an image forming apparatus employing a toner cartridge according to one embodiment of the present invention will be described. FIG. 1 is an explanatory sectional front view showing one example of an internal structure of the image forming apparatus 10 employing the toner cartridge according to the embodiment.

As shown in FIG. 1, the image forming apparatus 10 is designed to be used as a copying machine, which has a fundamental structure comprising a box-shaped apparatus body 11, so-called "wingless" or "internal exit tray" type, and an image read section 16 disposed above the apparatus body 11 and adapted to read a document image. The apparatus body 11 is internally equipped with an image forming section 12 for forming an image based on document image information read by the image read section 16, a fixing section 13 for subjecting an image transferred onto a sheet to a fixing treatment, and a sheet storage section 14 for storing an image transfer sheet.

The image read section 16 includes a document pressing member 161 attached to a top surface thereof in an openable/closable manner, and an optics unit 162 disposed in opposed relation to the document pressing member 161 through a contact glass 163 provided at a document read plane. The contact glass 163 is formed in a planar shape with a size slightly less than that of document pressing member 161 to facilitate reading a surface of a document placed thereon. The document pressing member 161 is designed to be rotatably opened and closed about a given axis along one edge of the top surface of the image read section 16 in opposite directions.

The image read section 16 includes a manual operation panel (not shown) for entering conditions of various processings, such as document reading and copying, at an appropriate position. Although not illustrated, this manual operation panel is provided with a display panel, and various keys and buttons, such as a start button and a mode select key.

The optics unit 162 includes (although not illustrated) a light source, a plurality of mirrors, a lens unit, and a CCD (Charge Coupled Device). In the optics unit 162, light from the light source is reflected by the document surface, and the reflected light serving as document image information is entered into the CCD through the mirrors and the lens unit. Then, the document image information entered into the CCD in the form of a certain analog quantity is converted to a digital signal, and stored on a given storage device.

The image forming section 12 serves as a means to form a toner image on a sheet fed from the sheet storage section 14. In this image forming apparatus, the image forming section 12 includes a magenta unit 12M, a cyan unit 12C, a yellow unit 12Y and a black unit 12K, which are arranged in this order from an upstream side (right side in FIG. 1) to a downstream side. Each of the units 12M, 12C, 12Y, 12K includes a photosensitive drum 121 and a development device 122. The photosensitive drum 121 is designed to receive toner supplied from the development device 122 while being rotated counterclockwise in FIG. 1.

Four of the toner cartridges 20 according to this embodiment are attached, respectively, at positions corresponding to the four development devices 122 of the units 12M, 12C, 12Y, 12K, in such a manner that each of the toner cartridges 20 is disposed in opposed relation to a surface of the corresponding development device 122 on the side of a front surface of the apparatus body 11 (the term "front" herein means the obverse side of the drawing sheet in FIG. 1). In this arrangement, each of the toner cartridges 20 is operable to supply a given color of toner to a corresponding one of the development devices 122 of the units 12M, 12C, 12Y, 12K.

An electrostatic charger 123 is disposed immediately below each of the photosensitive drums 121, and a light exposure device 124 is disposed below the chargers 123. Thus, a peripheral surface of each of the photosensitive drums 121 is uniformly charged by the corresponding charger 123, and then irradiated with a laser beam emitted from the light exposure device 124 in conformity to each color based on image data obtained from the image read section 16. Through this operation, an electrostatic latent image is formed on each peripheral surface of the photosensitive drums 121. Then, each of the development devices 122 supplies toner to the electrostatic latent image to form a toner image on the peripheral surface of the corresponding photosensitive drum 121.

A transfer belt 125 is wound around between a drive roller 125*a* and a driven roller 125*b* under tension, and disposed above the photosensitive drums 121 in such a manner as to be in contact with each of the photosensitive drums 121. This transfer belt 125 is designed to be circulatingly moved around between the drive roller 125*a* and the driven roller 125*b* in synchronization with each of the photosensitive drums 121 while being pressed onto the peripheral surfaces of the photosensitive drums 121 by four transfer roller 125*c* disposed, respectively, at positions corresponding to the photosensitive drums 121.

Thus, in conjunction with the circulating movement of the transfer belt 125, the magenta toner image on the photosensitive drum 121 of the magenta unit 12M is electrostatically transferred on to a surface of the transfer belt 125, and then the cyan toner image on the photosensitive drum 121 of the cyan unit 12C is transferred on to a surface of the transfer belt 125 at the same position as that of the transferred magenta toner image in an superimposed manner. Then, the yellow toner image on the photosensitive drum 121 of the yellow unit 12Y is transferred on to a surface of the transfer belt 125 at the same position in an superimposed manner, and finally the black toner image on the photosensitive drum 121 of the black unit 12K is transferred on to a surface of the transfer belt 125 in an superimposed manner. Thus, a color toner image is formed on the surface of the transfer belt 125. This color toner image formed on the surface of the transfer belt 125 will be transferred onto a sheet P fed from the sheet storage section 14.

A cleaning device 126 is disposed on the right (in FIG. 1) side of each of the photosensitive drums 121 to cleanly remove residual toner on the peripheral surface of the photosensitive drum 121; Then, the photosensitive drums 121 each having the peripheral surface cleaned by the cleaning device 126 will be moved toward the corresponding charger 123 to have a new electrostatic charge process.

Waste toner removed from the peripheral surface of the photosensitive drum 121 by the cleaning device 126 is collected to a toner collection bottle 29 through a given path, and stored therein.

A sheet feed path 111 is formed on the left (in FIG. 1) side of the image forming section 12. A feed roller pair 112 is interposed in the sheet feed path 111 at an appropriate position. This feed roller pair 112 is designed to be driven in such a manner as to feed a sheet from the sheet storage section 14 toward the transfer belt 125 wound around the drive roller 125*a*. A second transfer roller 113 in contact with the surface of the transfer belt 125 is disposed in the sheet feed path 111 at a position opposed to the drive roller 125*a*. When a sheet P being fed through the sheet feed path 111 is pressed/nipped between the transfer belt 125 and the second transfer roller 113, the second transfer roller 113 allows the toner image on the transfer belt 125 to be electrostatically absorbed into the sheet P so as to transfer the toner image to the sheet P.

A transfer belt cleaning device 127 is disposed at a right (in FIG. 1) end of the transfer belt 125 to remove residual toner on the surface of the transfer belt 125. Thus, the transfer belt 125 subjected to the process of transferring the toner image to the sheet P is circulatingly moved toward a next transfer process, in a state after residual toner is cleanly removed by the transfer belt cleaning device 127. A toner collection bottle 29' dedicated to the transfer belt cleaning device 127 is disposed below the transfer belt cleaning device 127.

The fixing section 13 serves as a means to allow the toner image transferred on the sheet through the image forming section 12 to be fixed on the sheet. The fixing section 13 comprises a fixing roller 131 internally having an electric heating element serving as a heating source, and a pressing roller 132 disposed in opposed relation to and on the left (in FIG. 1) side of the fixing roller 131. The sheet P subjected to the transfer process and led out of the image forming section 12 through the second transfer roller 113 is pressed/nipped between the fixing roller 131 and the pressing roller 132 and heated by the fixing roller 131. Through the nipping/heating process, the toner image is fixed to form a stable color image on the sheet.

The sheet P with the color image subjected to the fixing process is ejected through a sheet ejection path 114 extending from above the fixing section 13 to an internal exit tray 115 disposed inside the apparatus body 11.

The sheet storage section 14 includes a sheet tray 141 adapted to extractably inserted into an inner space of the apparatus body 11 below the light exposure device 124. The sheet tray 141 is designed to store a stack of sheets. A pickup roller 142 is driven to pick up the sheets P from the sheet stack in the sheet tray 141 one by one, and lead the sheets P to the image forming section 12 through the sheet feed path 111.

Figure 2:
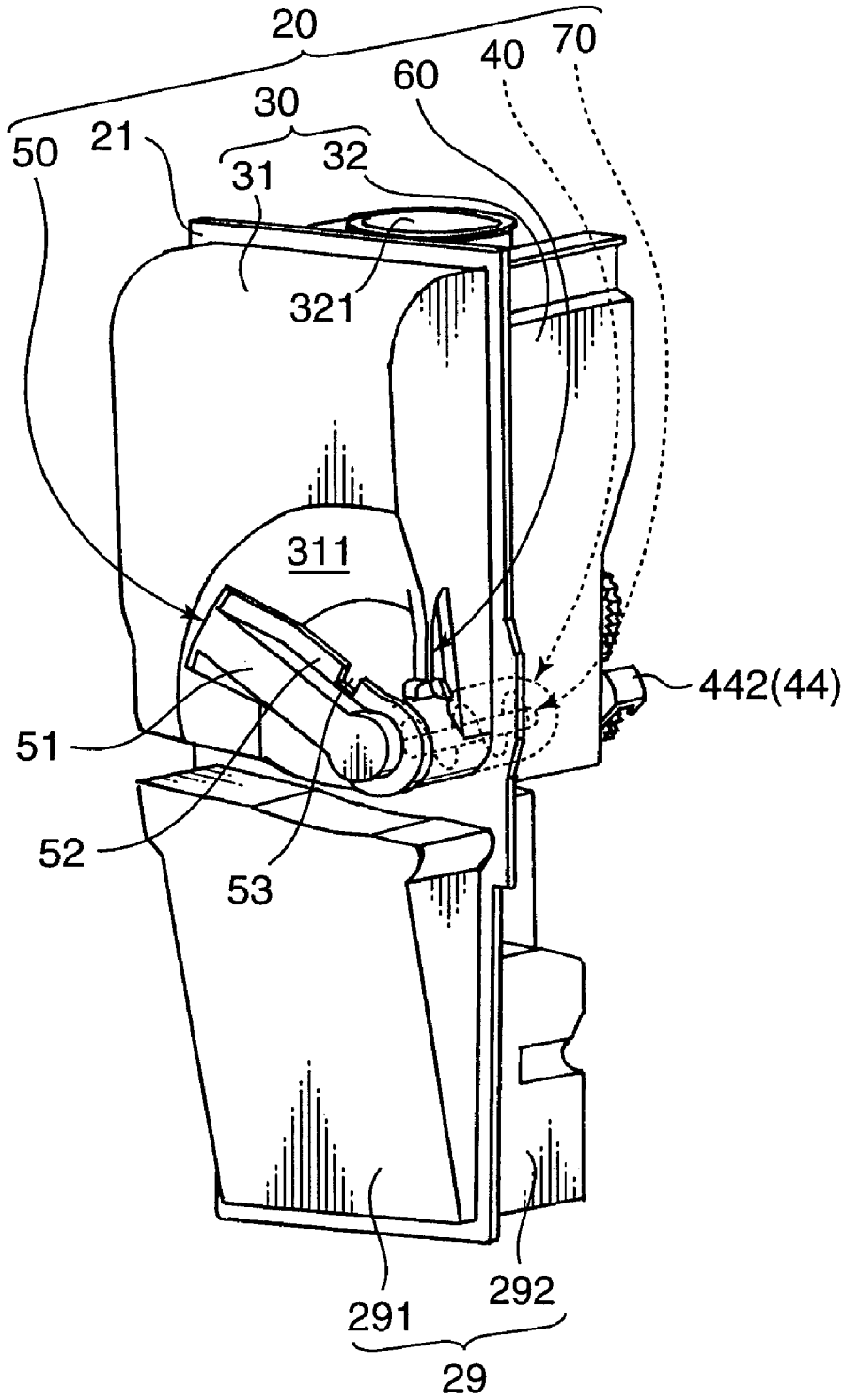
FIG. 2 is a perspective view showing the toner cartridge, seeing obliquely from the front side (the obverse side of the drawing sheet of FIG. 1).
Figure 3:
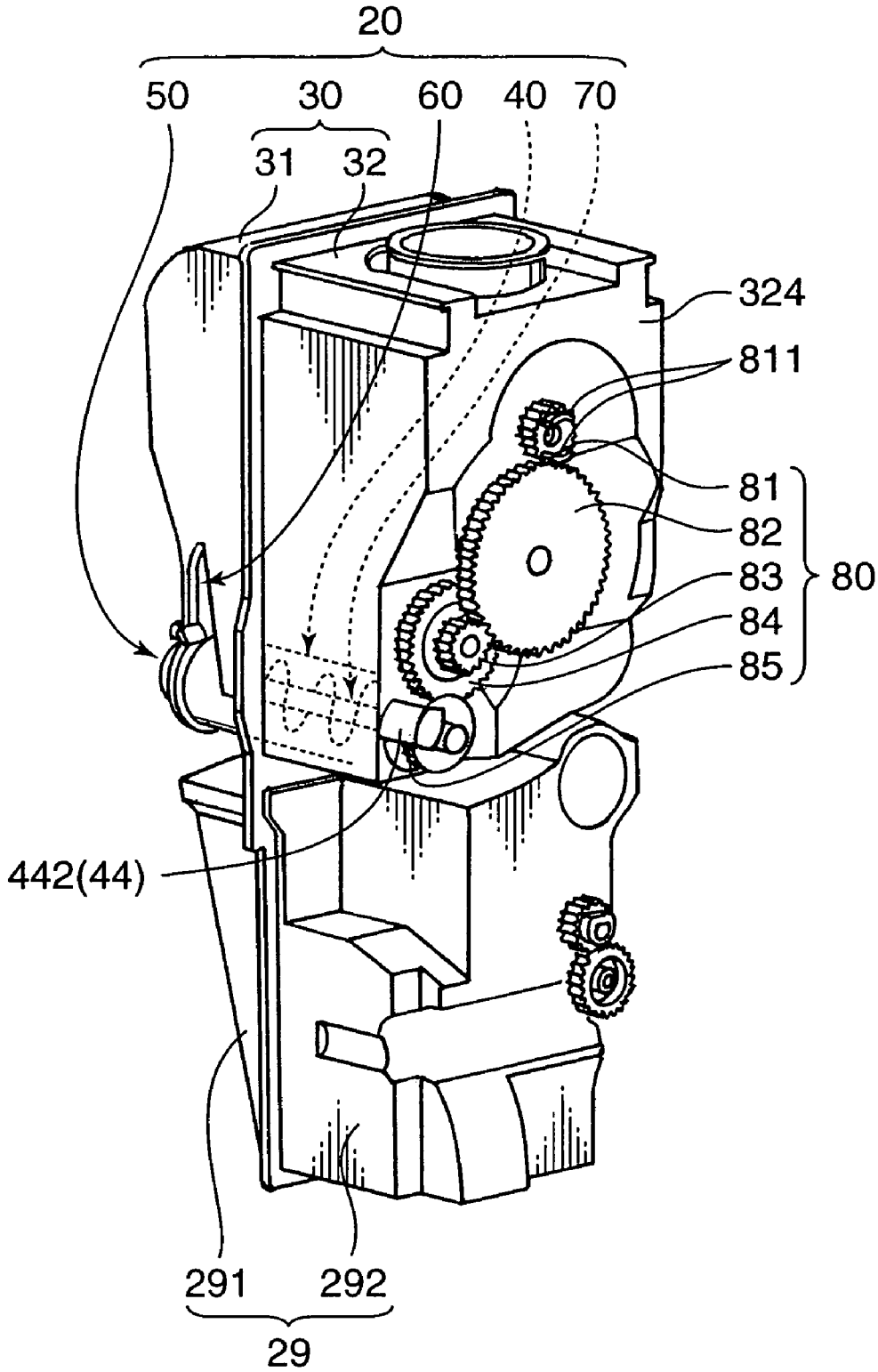
FIG. 3 is a perspective view showing the toner cartridge, seeing obliquely from the rear side (the reverse side of the drawing sheet of FIG. 1).

With reference to FIGS. 2 and 3, the toner cartridge 20 will be described in detail below. FIG. 2 is a perspective view showing the toner cartridge 20, seeing obliquely from the front side (the obverse side of the drawing sheet of FIG. 1). FIG. 3 is a perspective view showing the toner cartridge 20, seeing obliquely from the rear side (the reverse side of the drawing sheet of FIG. 1).

As shown in FIG. 2, the toner cartridge 20 fundamentally comprises a frame plate 21 having a vertically-elongated approximately rectangular shape, a cartridge body 30 formed over approximately the upper half of the frame plate 21, a shutter member (cylindrical body) 40 disposed on the right (in FIG. 2) side of a lower portion of the cartridge body 30, a manual operation lever 50 for manually opening and closing the shutter member 40, a postural-change restriction mechanism 60 for locking a movement of the manual operation lever 50 to restrict a postural change of the shutter member 40 between an open posture and a closed posture, and a spiral feeder (toner transport means) 70 for stirringly transporting toner in the cartridge body 30.

In the toner cartridge 20 according to this embodiment, the toner collection bottle 29 for storing collected toner is formed over approximately the lower half of the frame plate 21. This toner collection bottle 29 comprises a front bottle segment 291 protruding frontward from the frame plate 21, and a rear bottle segment 292 additionally protrudingly formed on the side of a rear surface of the frame plate 21. The frame plate 21 is formed to provide no partition between these bottle segments 291 and 292 so as to create a collected-toner storage space consisting of respective inner spaces of the front bottle segment 291 and the rear bottle segment 292.

This structure having the toner collection bottle 20 integrally formed with the cartridge body 30 through the frame plate 21 is employed in view of efficiency in an operation for replacing components. Specifically, in consideration of balance between the amount of toner consumption in the cartridge body 30 and the amount of toner collection in the toner collection bottle 20, respective capacities of the cartridge body 30 and the toner collection bottle 20 can be pre-determined to allow the toner collection bottle 29 to be filled up when the cartridge body 30 is emptied, and the cartridge body 30 and the toner collection bottle 20 can be advantageously replaced together in this timing.

The cartridge body 30 includes a front cartridge segment 31 protrudingly formed on the side of the front surface of the frame plate 21, and a rear cartridge segment 32 protrudingly formed on the side of the rear surface of the frame plate 21. The frame plate 31 is formed to provide no partition between the front cartridge segment 31 and the rear cartridge segment 32 so as to allow the cartridge body 30 to have a toner storage space consisting of respective inner spaces of the front cartridge segment 31 and the rear cartridge segment 32.

An operation-lever mounting portion 311 having a sector shape in front view is formed in a lower right (in FIG. 2) region of the front cartridge segment 31. This operation-lever mounting portion 311 is formed by concaving a front surface of the front cartridge segment 31 rearward by a given distance to have an arc shape with a curvature center at a given position of a lower right (in FIG. 2) corner of the front cartridge segment 31. The manual operation lever 50 is designed to have a thickness capable of preventing the manual operation lever 50 from protruding frontward from the front surface of the front cartridge segment 31 when the manual operation lever 50 is attached to this operation-lever mounting portion 311, so as to contribute to reduction in size of the toner cartridge 20.

The rear cartridge segment 32 has a top surface formed with a toner filling port 321 for putting toner into the cartridge body 30 therethrough, and a bottom surface formed with a toner supply port 322 (see FIG. 5) for supplying toner to the development device 122. Further, a driving-force transmission mechanism 80 (see FIG. 3) for driving the spiral feeder (toner transport means) 70 disposed in the cartridge body 30 is attached onto a rear surface of the rear cartridge segment 32. After a given amount of toner is put into the cartridge body 30, the toner filling port 321 is closed with a cap (not shown) in a manner that the cap is hardly opened. Because, after the toner is consumed, the toner cartridge 20 is replaced with a new toner cartridge 20 without refilling by a user, and therefore it is necessary to prevent the toner filling port 321 from being improperly opened by the user.

Figure 4:
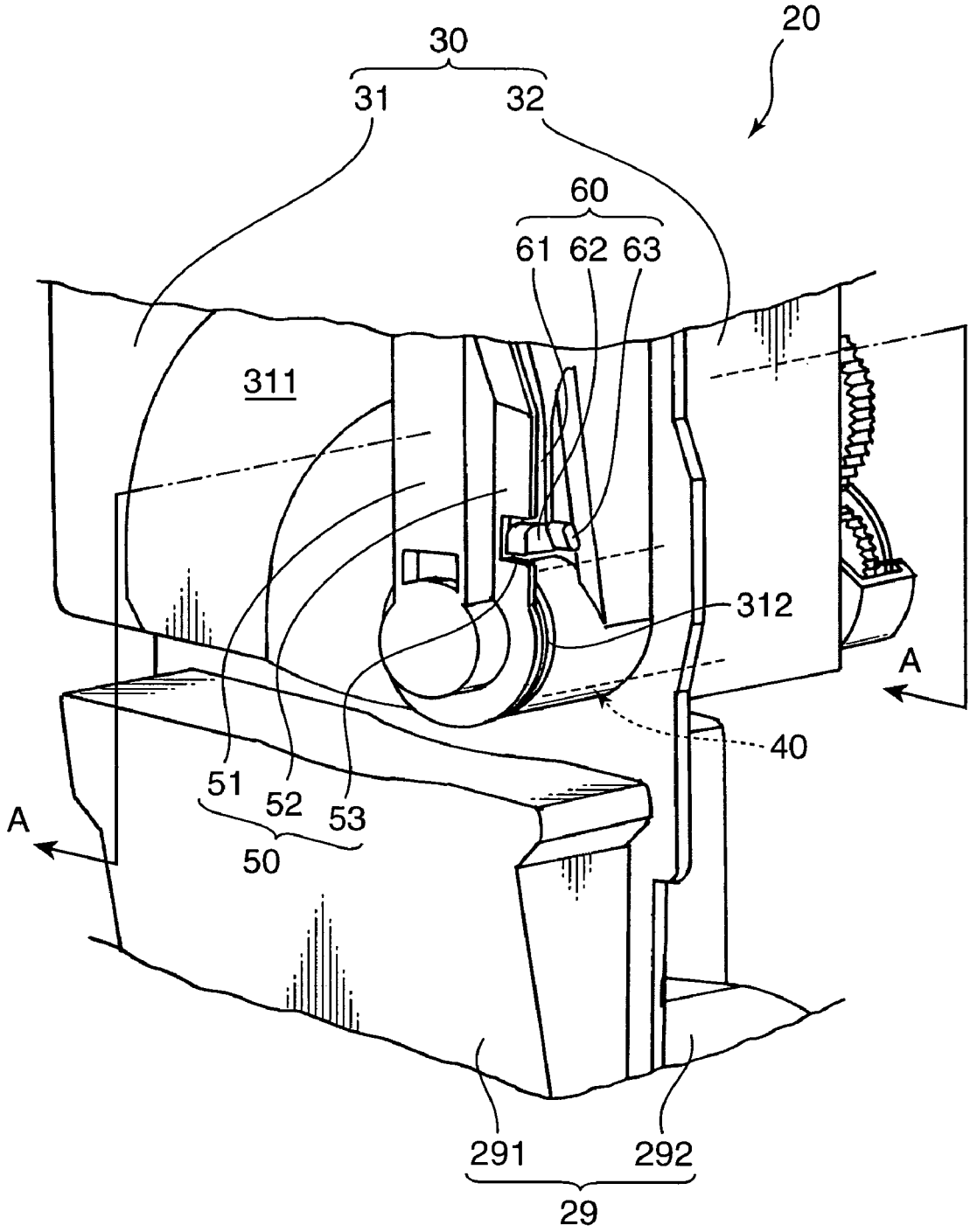
FIG. 4 is a fragmentary enlarged perspective view showing the toner cartridge.
Figure 5:
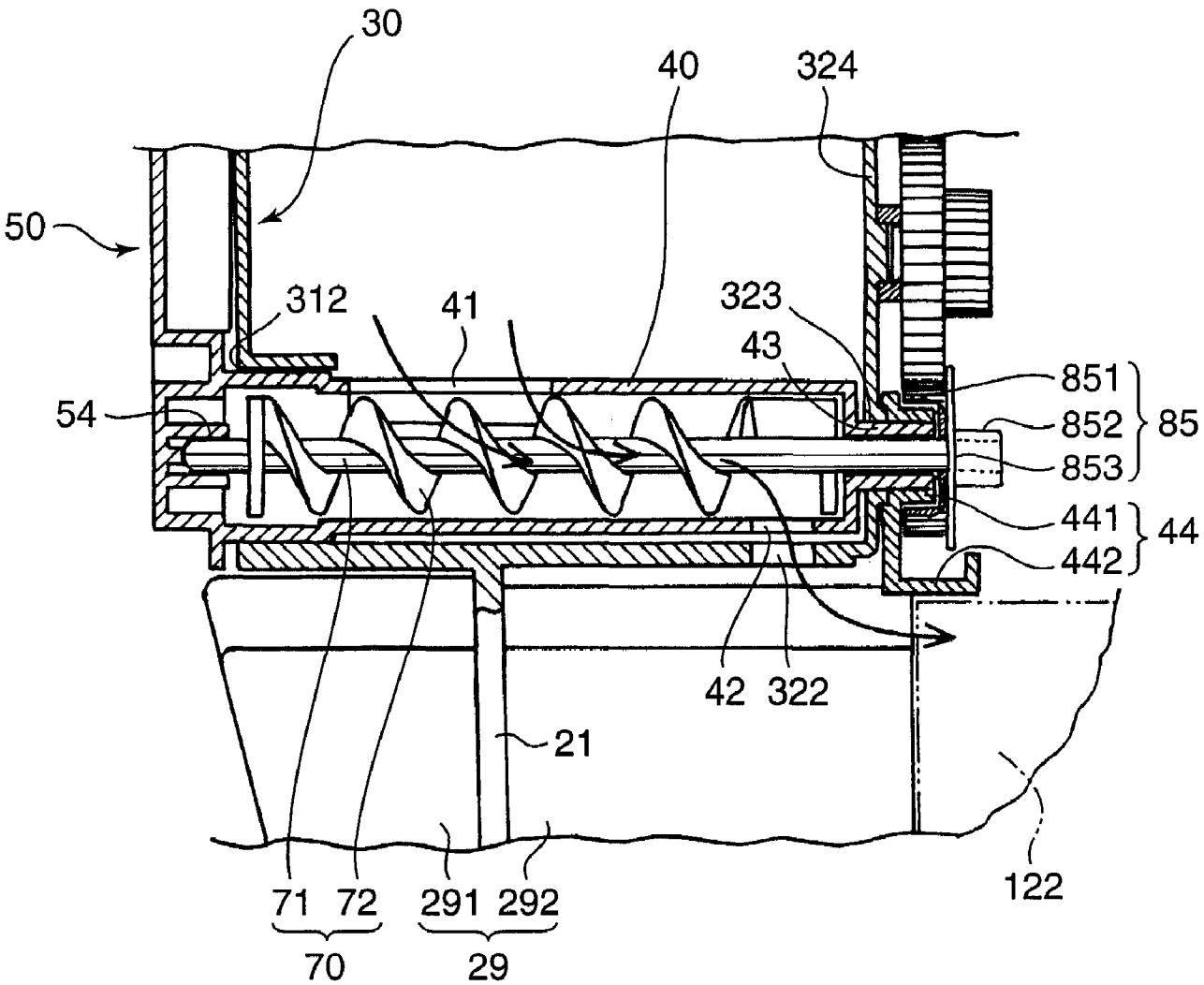
FIG. 5 is a sectional view taken along the line A-A of FIG. 4.

The shutter member 40, the manual operation lever 50 and the postural-change restriction mechanism 60 will be described in detail below with reference to FIGS. 4 to 6, in addition to FIGS. 1 to 3 as needed. FIG. 4 is a fragmentary enlarged perspective view showing the toner cartridge 20, and FIG. 5 is a sectional view taken along the line A-A of FIG. 4. FIG. 6 is an explanatory partially cut-cut skeletal perspective view showing respective movements of the shutter member 40, the manual operation lever 50 and the postural-change restriction mechanism 60, wherein FIG. 6A shows a state when the shutter member 40 is set in the closed posture, and FIG. 6B shows a state when the shutter member 40 is set in the open posture.

As shown in these figures, the shutter member 40 has a cylindrical body which is attached to the cartridge body 30 in such a manner as to penetrate a front wall of the front cartridge segment 31 and a rear wall of the rear cartridge segment 32 in a lower right (in FIG. 4) region of the cartridge body 30. In order to allow the shutter member 40 to penetrate the cartridge body 30 in a rotatable manner relative thereto, the front wall of the front cartridge segment 31 is formed with a through-hole 312, and the rear wall of the rear cartridge segment 32 is formed with a through-hole 323 (see FIG. 5).

The shutter member 40 is formed with a toner receiving opening 41 and a toner delivery opening 42, respectively, at a front end and a rear end thereof. When the shutter member 40 is set in the closed posture S1 as shown in FIG. 6A, the toner receiving opening 41 is positioned to face rightward, and the toner delivery opening 42 is positioned to face leftward. That is, the toner receiving opening 41 and the toner delivery opening 42 are formed in the shutter member 40 in diagonal relation to one another (or with a phase shift of 180°). The manual operation lever 50 is integrally formed with the front end of the shutter member 40.

Figure 6A:
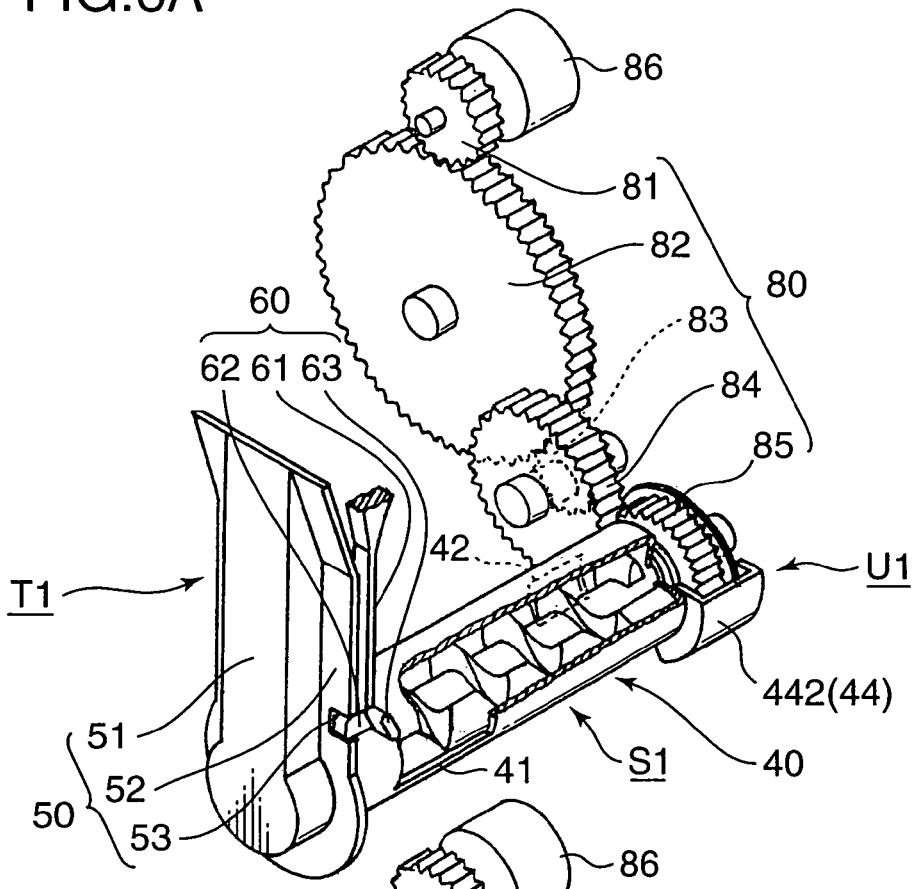
FIG. 6A shows a state when the shutter member is set in a closed posture.
Figure 6B:
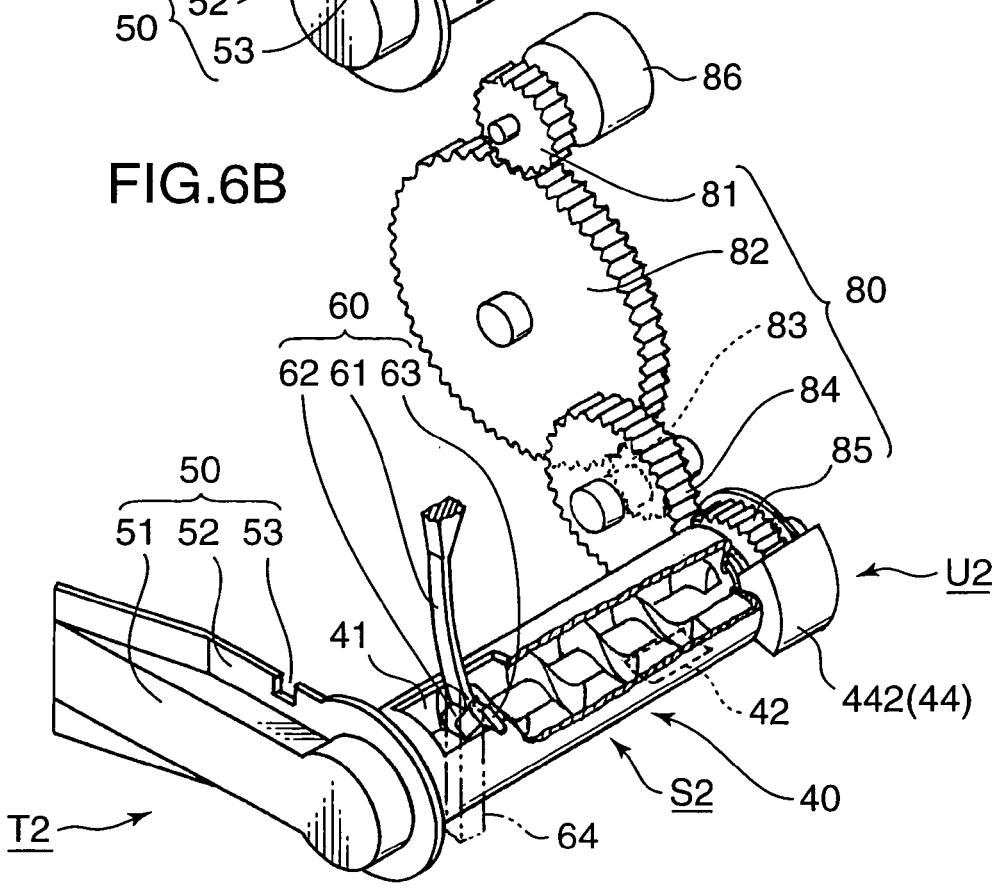
FIG. 6B shows a state when the shutter member is set in an open posture.

As above, when the shutter member 40 is set in the closed posture S1, the toner receiving opening 41 is positioned to face laterally as shown in FIG. 6A so as to preclude toner from being introduced into the shutter member 40, and the toner delivery opening 42 is positioned to face laterally, or positioned out of alignment with the toner supply port 322 (see FIG. 5), so as to prevent toner from being discharged outside through the toner supply port 322.

Then, when the manual operation lever 50 set in an upstanding posture T1 corresponding to the closed posture S1 (FIG. 6A) of the shutter member 40 is rotated counterclockwise about an axis of the cylindrical body of the shutter member 40 by about 90° and changed in posture to a lying posture T2, the shutter member 40 set in the closed posture S1 is rotated about the axis of the cylindrical body by about 90° and changed in posture to the open posture S2 as shown in FIG. 6B. Through this operation, the toner receiving opening 41 is positioned to face upward, and the toner delivery opening 42 is positioned to face downward. This allows the toner in the cartridge body 30 to be discharged from the toner delivery opening 42 through the inner space of the shutter member 40.

The rear end (on the opposite side of the front end formed with the manual operation lever 50) of the shutter member 40 is provided with an engagement member 44 for allowing the toner cartridge 20 to be engaged with a cartridge mounting frame 90 (see FIG. 7) of the apparatus body 11 (see FIG. 1). This engagement member 44 includes an outer tube 441 fixedly fitted onto a small-diameter tubular portion 43 (see FIG. 5) concentrically protruding from the rear end of the cylindrical body of the shutter member 40 and having a diameter slightly less than that of the cylindrical body, and a sector-shaped hook 442 protruding radially outward from an outer peripheral surface of the outer tube 441 having a sector shape in back view.

The sector-shaped hook 442 has a hook-like shape in sectional view taken along a plane intersecting with and parallel to the axis of the cylindrical body of the shutter member 40, and extends rearward beyond a rear end of the outer tube 441 by a given distance, as shown in FIG. 5.

The engagement member 44 is arranged to be positioned laterally as shown in FIG. 6A when the shutter member 40 is set in the closed posture S1, and to be positioned obliquely upward as shown in FIG. 6B when the shutter member 40 is set in the open posture S2. Specifically, when the toner cartridge 20 is attached to the cartridge mounting frame 90 in such a manner that an upper portion of the toner cartridge 20 is positioned in opposed relation to the development device 122, and then the manual operation lever 50 set in the upstanding posture T1 is turned over to change the upstanding posture T1 to the lying posture T2, the engagement member 44 is gradually fitted into an arc-shaped engagement groove 912 formed at an appropriate position of the cartridge mounting frame 90 so as to allow the toner cartridge 20 to be held by or latched relative to the cartridge mounting frame 90.

That is, when the manual operation lever 50 is set in the upstanding posture T1, the engagement member 44 is set in a disengagement (or engagement-released) posture U1 where the sector-shaped hook 442 protrudes laterally from the outer tube 441, as shown in FIG. 6A. When the manual operation lever 50 is set in the lying posture T2, the engagement member 44 is set in an engagement posture U2 where the sector-shaped hook 442 protrudes obliquely upward from the outer tube 441 along the arc-shaped engagement groove 912, as shown in FIG. 6A.

When the manual operation lever 50 is changed in posture from the upstaging position T1 to the lying position T2 after the toner cartridge 20 is attached to the development device 122, the sector-shaped hook 442 is set in the engagement posture U2 and latched relative to the apparatus body 11. That is, in the operation for replacing the toner cartridge 20, the latch state in which the sector-shaped hook 442 set in the engagement posture U2 is latched relative to the apparatus body 11 can be released only after the manual operation lever 50 is returned to the upstanding posture T1.

Thus, in the replacement operation of the toner cartridge 20, the manual operation lever is unexceptionally returned from the lying posture T2 to the upstanding posture T1, and therefore the shutter member 40 is changed in posture from the open posture S2 to the closed posture S1 to close the toner supply port 322. This makes it possible to reliably prevent a problem about occurrence of residual-toner leakage from the used toner cartridge 20 taken out of the apparatus body 11 during the replacement operation of the toner cartridge 20.

As shown in FIG. 4, the manual operation lever 50 includes a lever body 51 protruding radially from the front end of the shutter body 40, and a flange plate 52 protruding outward from an edge of the lever body 51. Further, the flange plate 52 is formed with a U-shaped lock groove (lock element) 53 on the right side of the lever body 51. This lock groove 53 is formed as a notch extending from an outer edge of the flange plate 52 toward the lever body 51. The lock groove 53 is provided as a means to restrict a postural change of the shutter member 40 set in the closed posture S1 to the open posture S2, in cooperation with other element of the postural-change restriction mechanism 60.

The postural-change restriction mechanism 60 serves as a means to restrict a postural change of the shutter member 40 set in the closed posture S1 to the open posture S2 (i.e. to lock the upstanding posture T1 of the shutter member 40) when the cartridge 20 is not attached to the development device 122, and to release the restriction when the cartridge 20 is attached to the development device 122.

As shown in FIG. 4, the postural-change restriction mechanism 60 comprises the above lock groove 53, an elongated restriction arm 61 extending downward from an upper end of the operation-lever mounting portion 311 in a right (in FIG. 4) sidewall of the front cartridge segment 31, a restriction pawl (lock protrusion (blocking element)) 62 protruding frontward from an lower end of the restriction arm 61 toward the lock groove 53 of the manual operation lever 50 set in the upstanding posture T1, and a follower pawl 63 protruding rightward (in FIG. 4) from the lower end of the restriction arm 61.

The restriction arm 61 is designed to have a thickness capable of being elastically deformed in a frontward/rearward direction relative to the manual operation lever 50, and to allow the restriction pawl 62 to be fitted into the lock groove 53 when the manual operation lever 50 is set in the upstanding posture T1 (see FIG. 6A). Thus, the restriction pawl 62 fitted into the lock groove 53 can block a counterclockwise movement of the manual operation lever 50 about the axis of the cylindrical body of the shutter member 40. When the restriction arm 61 is bent rearward to release the engagement of the restriction pawl 62 relative to the lock groove 53, the manual operation lever 50 can be changed in posture from the upstanding posture T1 to the lying posture T2.

Further, an interference member 64 (indicated by the two-dot chain line in FIG. 6B) corresponding to the follower pawl 63 is fixed to the apparatus body 11 at an appropriate position. Thus, when the toner cartridge 20 is attached to the development device 122, the follower pawl 63 will be brought into interference with the interference member 64. Thus, as shown in FIG. 6B, the lower end of the restriction arm 61 is bent in a direction getting away from the manual operation lever 50 so as to allow the restriction pawl 62 to be disengaged from the lock groove 53. When the restriction pawl 62 is disengaged from the lock groove 53, the manual operation lever 50 set in the upstanding posture T1 can be changed in posture to the lying position T2.

As shown in FIG. 5, the spiral feeder 70 includes a feeder shaft 71 extending laterally through the cartridge body 30 in concentric relation to the axis of cylindrical body of the shutter member 40, and a spiral fin 72 integrally formed with a peripheral surface of the feeder shaft 71. The feeder shaft 71 has a front (left side in FIG. 5) end inserted into a mounting hole 54 formed in a rear surface of the lever body 51 in an axially rotatable manner, and a rear end penetrating through the small-diameter tube portion of the shutter member 40 in a rotatable manner relative thereto. Thus, the spiral feeder 40 can be axially rotated independently of the cylindrical body of the shutter member 40.

When the shutter member 40 is set in the closed posture S1, and the spiral feeder 40 is rotated about the feeder shaft 71, toner introduced into the shutter member 40 through the toner receiving opening 41 is guided by a rotation of the spiral fin 72 and moved rearward. Then, the toner will be supplied to the development device 122 through the toner delivery opening 42 and the toner supply port 322.

The driving-force transmission mechanism 80 serves as a means to transmit to the spiral feeder 70 a driving force of a driving motor 86 (see FIG. 6) disposed at an appropriate position in the apparatus body 11. As shown in FIG. 3, the driving-force transmission mechanism 70 is attached to the rear wall 324 of the rear cartridge segment 32. The driving-force transmission mechanism 80 comprises a coupling gear 81 disposed slightly above a central region of the rear wall 324 of the rear cartridge segment 32, and a first idle gear 82 formed to have a diameter fairly greater than the coupling gear 81 and engaged with the coupling gear 81 below the coupling gear 81, a second idle gear 83 engaged with the first idle gear 82 on the lower left (in FIG. 3) side of the first idle gear 82, and a third idle gear 84 formed integrally and concentrically with the second idle gear to be rotated together therewith, and a feeder gear 85 attached fixedly to a portion of the feeder shaft 71 protruding rearward from the rear wall 324 and in concentric relation to the feeder shaft 71.

As shown in FIG. 3, the coupling gear 81 has a rear surface formed with or fixed to a pair of coupling pieces 811 symmetric with respect to an axis of the coupling gear 81. When the cartridge 20 is attached to the development device 122, the coupling gear 81 is concentrically connected to a drive shaft of the driving motor 86 through the coupling pieces 811 to allow a torque of the driving motor 86 to be transmitted to the coupling gear 81.

As shown in FIG. 5, the feeder gear 85 comprises a feeder gear body 851 loosely fitted onto the small-diameter tube 43 of the shutter member 40 in a concentric manner, an outer tubular member 852 having a diameter less than that of the feeder body 851, and a flange 853 interposed between the feeder body 851 and the outer tubular member 852 in concentric manner. The outer tubular member 852 is fixedly fitted onto the feeder shaft 71 in an integrally rotatable manner so as to transmit a rotation of the feeder gear 85 to the spiral feeder 70.

According to the driving-force transmission mechanism 80, when the driving motor 86 is activated after the toner cartridge 20 is attached to the development device 122, a driving force of the driving motor 86 is transmitted to the coupling gear 81 through the coupling pieces 811, and then a rotation of the coupling gear 81 is transmitted to the feeder gear 85 through the first idle gear 82, the second idle gear 83 and the third idle gear 84 which are engaged with each other in this order. Then, the spiral feeder 70 in the cylindrical body of the shutter member 40 is rotated by a rotation of the feeder gear 85 about the feeder shaft 71.

Thus, as shown in FIG. 6B, when the driving motor 86 is activated after the manual operation lever 50 is manually turned over to set the shutter member 40 in the open posture S2, toner introduced from the cartridge body 30 into the shutter member 40 through the upward-facing toner receiving opening 41 of the shutter member 40 is guided by a rotation of the spiral fin 72 about the feeder shaft 71 and transported in a rightward direction in FIG. 6B, and supplied to the development device 122 (see FIG. 1) through the toner delivery opening 42 and the toner supply port 322.

Figure 7:
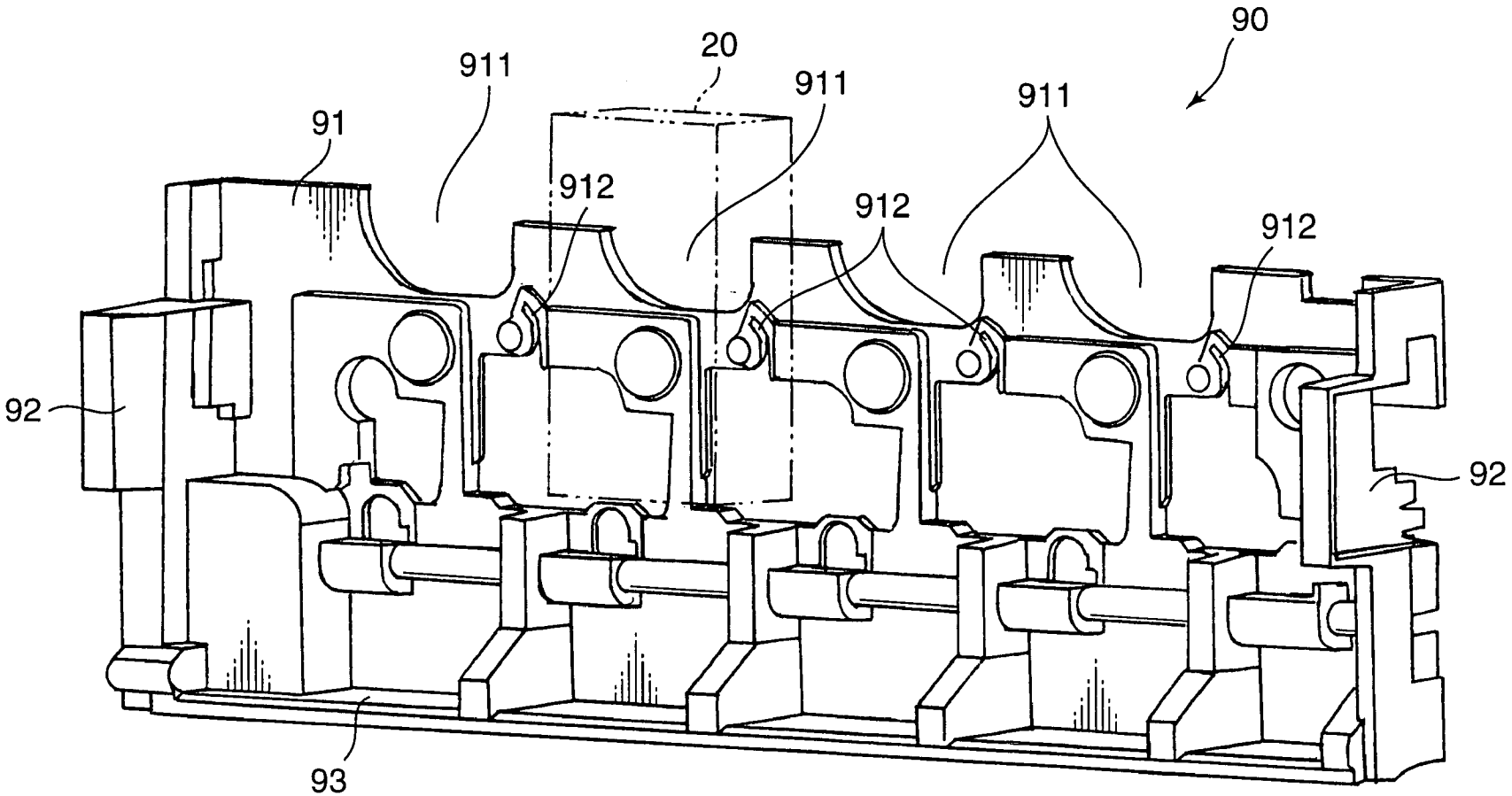
FIG. 7 is a perspective view showing one example of a cartridge mounting frame fixed inside a main body of the image forming apparatus to mount the toner cartridge, seeing from the rear side of the image forming apparatus.

FIG. 7 is a perspective view showing one example of the cartridge mounting frame 90 fixed inside the apparatus body 11 to mount the toner cartridge 20, seeing from the rear side of the image forming apparatus 10. The cartridge mounting frame 90 is fixed inside the apparatus body 11 at a position on the front side (obverse side of the drawing sheet of FIG. 1) of the image forming section 12, or at a position where an operator can visually check cartridge mounting frame 90 by opening a front door (not shown) of the apparatus body 11.

The cartridge mounting body 90 comprises a laterally-elongated frame plate 91, a pair of side plates 92 disposed on laterally opposite sides of the laterally-elongated frame plate 91 in opposed relation to one another, and a bottom plate 93 bridged between respective lower edges of these side plates 92. The frame plate 91 has an upper edge formed with four mounting cutout portions 911 each corresponding to a lower edge of the rear cartridge segment 32 of the cartridge body 30 (see FIGS. 2 and 3). In an operation for attaching the toner cartridge 20 (indicated by the two-dot chain line in FIG. 7) to the frame plate 91, the lower edge of the rear cartridge segment 32 is inserted into one of the mounting cutout portions 911 to allow the toner cartridge 20 to be attached to the frame plate 91 in the right place.

Further, the frame plate 91 is formed with the aforementioned arc-shaped engagement groove 912 corresponding to the sector-shaped hook 442 (see FIG. 6) of the shutter member 40 just below each right (in FIG. 7) edge of the mounting cutout portions 911. In the above cartridge mounting body 90, when the manual operation lever 50 is turned over and changed in posture from the upstaging position T1 to the lying position T2 after the toner cartridge 20 is attached to the frame plate 91, the sector-shaped hook 422 is gradually fitted into the arc-shaped engagement groove 912 in conjunction with a rotation of the shutter member 40 to allow the toner cartridge 20 to be latched relative to the frame plate 91.

In a state after the toner cartridge 20 is attached to the frame plate 91, the toner supply port 322 (see FIG. 5) of the toner cartridge 20 is positioned opposed to a toner charge port of the development device (not shown in FIG. 7; see FIG. 1). Thus, when the manual operation lever 50 is manually set in the open posture S2, toner stored in the cartridge body 30 is supplied to the development device 122 through the toner supply port 322 and the toner charge port.

Figures 8A, 8B, 8C:
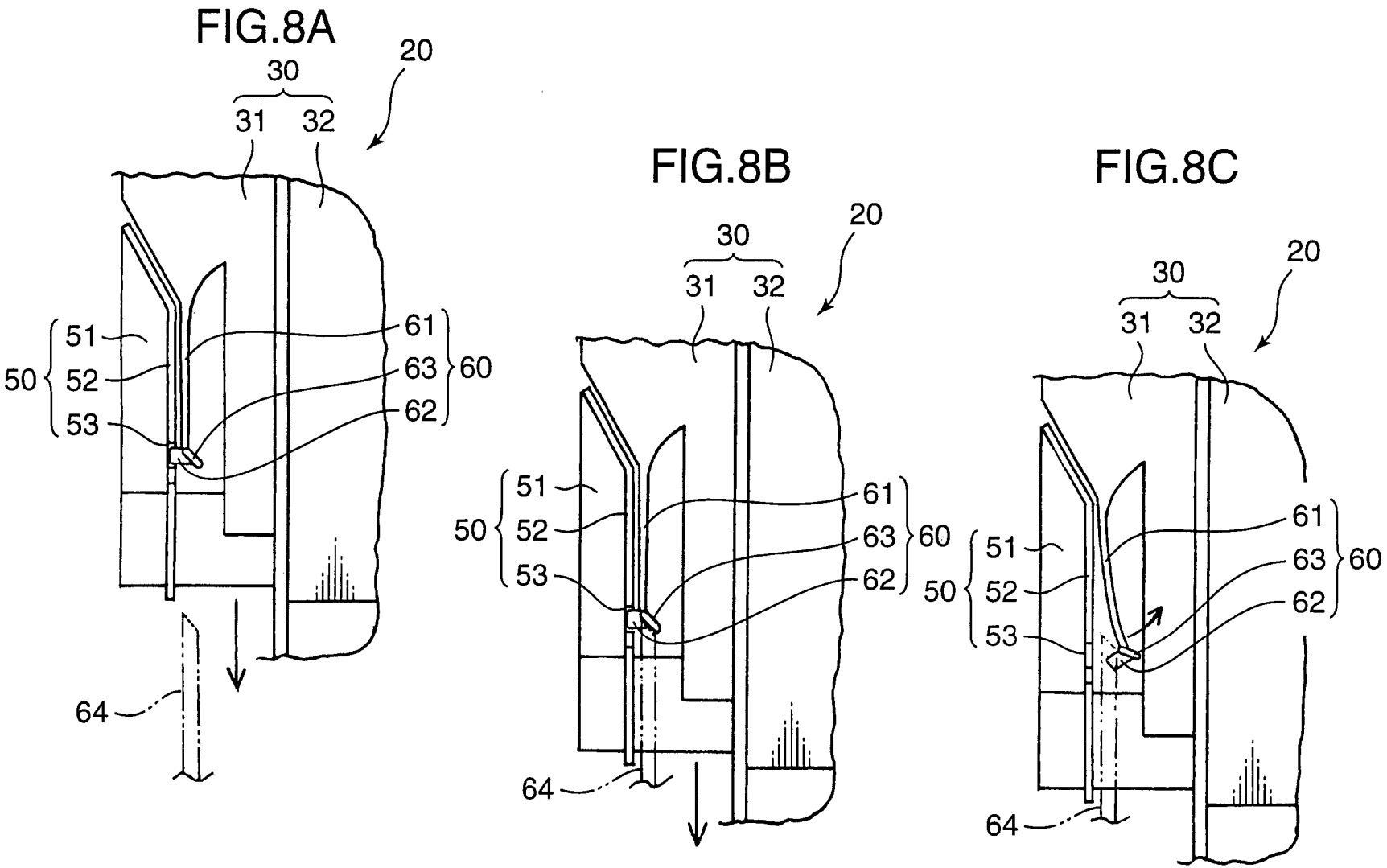
FIGS. 8A, 8B and 8C shows, respectively, a state when the toner cartridge is not attached to the cartridge mounting frame, a state when the toner cartridge is being attached to the cartridge mounting frame, and a state after the toner cartridge is attached to the cartridge mounting frame.

An operation of the postural-change restriction mechanism 60 will be described in more detail below with reference to FIG. 8 in addition to FIG. 1 to 7 as needed. FIG. 8 is explanatory fragmentary side view showing the operation of the postural-change restriction mechanism 60 of the toner cartridge 20, wherein FIGS. 8A, 8B and 8C shows, respectively, a state when the toner cartridge 20 is not attached to the cartridge mounting frame 90 (see FIG. 7), a state when the toner cartridge 20 is being attached to the cartridge mounting frame 90, and a state after the toner cartridge 20 is attached to the cartridge mounting frame 90.

Firstly, when the toner cartridge 20 is not attached to the cartridge mounting frame 90 (or not attached to the development device 122) as shown in FIG. 8A, the restriction pawl 62 at the lower end of the restriction arm 61 formed in the cartridge body 30 is fitted into the lock groove 53 of the manual operation lever 50. In this state, even if an operator attempts to rotate the manual operation lever 50 counter-clockwise, a lower edge of the lock groove 53 interferes with the restriction pawl 62 to preclude the manual operation lever 50 from being turned over. Thus, the shutter member 40 set in the closed posture S1 (see FIG. 6A) is never changed in posture to the open posture S2. This makes it possible to prevent occurrence of a problem about scattering of toner from the cartridge body 30 due to improper operation of the manual operation lever 50.

Then, when the toner cartridge 20 is being attached to the cartridge mounting frame 90, the follower pawl 63 formed in the lower end of the restriction arm 61 is brought into contact with the interference member 64 fixed to the apparatus body 11 at an appropriate position, as shown in FIG. 8B. In this state, when the toner cartridge 20 is further pushed toward the cartridge mounting frame 90, the follower pawl 63 is pressed rightward (in FIG. 8) by the interference member 64, and therefore the restriction arm 61 is elastically deformed curvedly (see FIG. 8C). According to this elastic deformation, the restriction pawl 62 at the lower end of the restriction arm 61 is disengaged from the lock groove 53 to allow the manual operation lever 50 to be manually rotated.

As mentioned above in detail, the toner cartridge 20 according to the above embodiment of the present invention is adapted to supply toner to the development device 122 incorporated in the image forming apparatus 10, through the toner supply port 322 in the state after being detachably attached to the development device 122 through the cartridge mounting frame 90. The toner cartridge 20 comprises the shutter member 40 adapted to be changed in posture between the closed posture S1 for closing the toner supply port 322 and the open posture S2 for opening the toner supply port 322, the manual operation lever 50 adapted to be manually operated so as to change the posture of the shutter member 40, and the postural-change restriction mechanism 60 for restricting a postural change of the shutter member 40 set in the closed posture S1 to the open posture S2. The postural-change restriction mechanism 60 includes the lock groove 53 formed in the manual operation lever 50 to serve as a lock element, and the restriction pawl 62 integrated with the cartridge body 30 to serve as a blocking element. The restriction pawl 62 is adapted to be engaged with the lock groove 53 when the manual operation lever 50 is operated to set the shutter member 40 in the closed posture S1, so as to block a postural change of the shutter member 40, and to be elastically deformed (in the above embodiment, the restriction arm 61 is elastically deformed) when the cartridge body 30 is attached to the development device 122, in such a manner as to be released from the engagement with the lock groove 53 to allow the postural change of the shutter member 40 to the open posture S2.

According to the above toner cartridge 20, after the toner cartridge 20 is attached to the development device 122, the manual operation lever 50 is operated to change a posture of the shutter member 40 from the closed posture S1 to the open posture S2 so as to open the toner supply port 322 formed in the bottom of the cartridge body 30. Through this operation, toner contained in the cartridge body 30 is supplied to the development device 122 through the toner supply port 322.

When the toner cartridge 20 is not attached to the development device 122, the restriction pawl 62 is engaged with the lock groove 53 formed in the manual operation lever 50, to preclude the manual operation lever 50 from being operated. Thus, even if an operator improperly attempts to operate the manual operation lever 50 in either state before the toner cartridge 20 is attached to the development device 122 and after the toner cartridge is detached from the development device 122, the manual operation lever 50 is never moved. This prevents occurrence of a problem about outside leakage of toner from the toner supply port 322 due to a wrong operation of the manual operation lever 50.

Further, the lock groove 53 concavedly formed in the manual operation lever 50 is employed as a lock element, and the restriction pawl 62 adapted to be fitted into the lock groove 53 is employed as a blocking element or a lock. Thus, when the toner cartridge 20 is not attached to the development device 122, the restriction pawl 62 fixed to the cartridge body 30 is fitted into the lock groove 53 formed in the manual operation lever 50 so as to restrict a postural change of the shutter member 40 from the closed posture S1 to the open posture S2. Further, when the toner cartridge is attached to the development device 122, the restriction pawl 62 is disengaged from the lock groove 53 so as to allow the shutter member 40 to be changed in posture between the closed posture S1 and the open posture S2.

Further, the shutter member 40 has a cylindrical body including the toner delivery opening 42 formed in one end of the cylindrical body at a position capable of being opposed to the toner supply port 322, the toner receiving opening 41 formed in the other end of the cylindrical body at a position diagonal relative to the toner delivery opening 42 and adapted to receive toner from the cartridge body 30 to an inner space of the cylindrical body, and the spiral feeder 70 adapted to be rotated in concentric relation to the cylindrical body so as to transport toner from the toner receiving opening 41 to the toner delivery opening 42. Thus, when the manual operation lever 50 is manually operated to rotate the shutter member 46 about the axis of the cylindrical body in such as manner as to allow the toner delivery opening 42 to be positioned opposed to the toner supply port 322 of the bottom of the cartridge body 30, the toner receiving opening 41 formed at a position diagonal relative to the toner delivery opening 42 is positioned to face upward. In this state, the spiral feeder 70 can be axially rotated to allow toner in the cartridge body 30 to be guided from the toner receiving opening 41 to the toner delivery opening 42 according to a rotation of the spiral feeder 70, and supplied to the development device 122 through the toner supply port 322.

Further, when the manual operation lever 50 is manually operated to rotate by a given angle the shutter member 40 having the toner delivery port 42 opposed to the toner supply port 322 so as to eliminate the alignment of the toner delivery port 42 relative to the toner supply port 322, the toner supply port 322 can be closed by the peripheral surface of the cylindrical body of the shutter member 40, so as to reliably prevent toner leakage from the toner cartridge 20 through the toner delivery opening 42.

Furthermore, in the above embodiment, the spiral feeder 70 having the spiral fin 72 is employed as toner transport means. Thus, the spiral feeder 70 can be rotated about the spiral shaft 71 to transport toner in the shutter member 40 toward the toner delivery 42 opening according to guide of the spiral fin 72.

The space-saving spiral feeder 70 employed as toner transport means can contribute to reduction in size of the toner cartridge 20 and makes it possible to reliably transport toner toward the toner delivery opening 42 through a relatively narrow inner space of the shutter member 40.

The present invention is not limited to the above embodiment. For example, the following modifications may be made therein.

While the toner cartridge 20 according to the above embodiment employs the lock groove 53 and the restriction pawl 62 serving, respectively, as a lock element and a blocking element, the present invention is not limited to the above relationship where the lock element is the lock groove 53 and the blocking element is the restriction pawl 62, but this relationship may be reversed, i.e., the restriction pawl and the lock groove may be designed to serve, respectively, as a lock element and a blocking element.

While the toner cartridge 20 according to the above embodiment is designed such that, when the manual operation lever 50 is operated to turn over the toner cartridge toward the lying posture T2, the engagement member 44 is engaged with the mounting cutout portion 911 of the frame member 91 so as to allow the toner cartridge 20 to be latched relative to the frame plate 91 through the shutter member 40, the present invention is not limited to the above the toner cartridge 20 having the engagement member 44. For example, the toner cartridge 20 may be designed such that a give mounting notched portion for mounting the toner cartridge 20 is formed in the frame member, and the toner cartridge 20 is fitted into the mounting notched portion from above. In this case, the engagement member 44 may be omitted.

While the postural-change restriction mechanism 60 in the above embodiment includes the rod-shaped elastically-deformable restriction arm 61, and the restriction pawl 62 and the follower pawl 63 each formed at the lower end of the restriction arm 61, the postural-change restriction mechanism 60 may be designed to press the restriction pawl 62 by means, for example, of a biasing force of a coil spring, so as to fit the restriction pawl 62 into the lock groove 53.

Figure 8E:
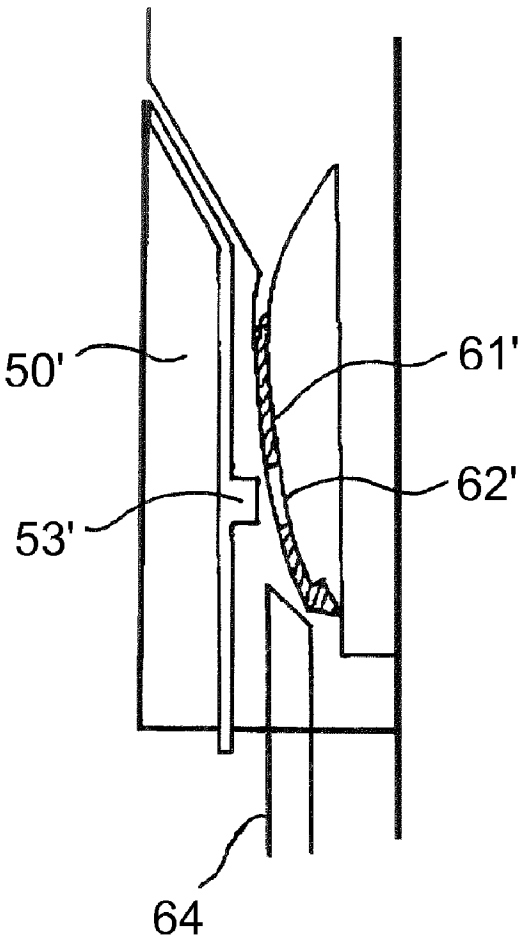
FIGS. 8D and 8E are similar respectively to FIGS. 8B and 8C but show a reversed disposition of the lock protrusion and the lock groove so that the lock groove is formed on the manual operation lever and the lock protrusion is formed on the locking element.
Figure 8D:
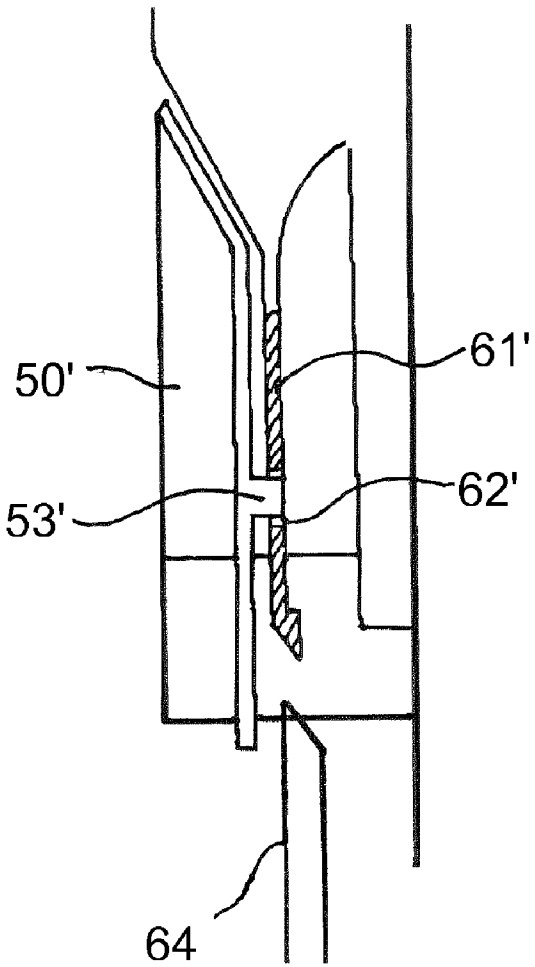

While the toner cartridge 20 according to the above embodiment is designed such that the lock groove 53 serving as a lock element is formed in the manual operation lever 50, and the restriction pawl 62 serving as a blocking element is formed in the cartridge body 30, this relationship may be reversed, i.e., a lock groove 62' serving as a lock element is formed in a restriction arm 61' of the cartridge body 30, and the restriction pawl 53' serving as a blocking element is formed in or fixed to the manual operation lever 50', as shown in FIGS. 8D and 8E. This structure can also obtain substantially the same effect.

This application is based on patent application No. 2005-023238 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A toner cartridge adapted to be detachably attached to a given image forming apparatus, comprising:

a cartridge body for supplying toner to a development device incorporated in said image forming apparatus, through a toner supply port;

a shutter member adapted to be changed in posture between an open posture for opening said toner supply port and a closed posture for closing said toner supply port;

a manual operation lever adapted to be manually operated so as to change the posture of said shutter member; and a postural-change restriction mechanism for restricting a postural change of said shutter member set in said closed posture to said open posture, said postural-change restriction mechanism including:

a lock groove formed in either one of said manual operation lever and said cartridge body; and a blocking element integral with the other one of said manual operation lever and said cartridge body, said blocking element including a lock protrusion adapted to be engaged with said lock groove when said manual operation lever is operated to set said shutter member in said closed posture, so as to block a postural change of said shutter member, and to be elastically deformed when said cartridge body is attached to said image forming apparatus, in such a manner as to be released from the engagement with said lock groove to allow the postural change of said shutter member to said open posture.

2. The toner cartridge as defined in claim 1, wherein:

said shutter member has a cylindrical body which includes:

a toner delivery opening formed in one end of said cylindrical body at a position capable of being opposed to said toner supply port;

a toner receiving opening formed in the other end of said cylindrical body at a position diagonal relative to said toner delivery opening and adapted to receive toner from said cartridge body to an inner space of said cylindrical body; and toner transport means adapted to be rotated in concentric relation to said cylindrical body so as to transport toner from said toner receiving opening to said toner delivery opening.

3. The toner cartridge as defined in claim 2, wherein said toner transport means comprises a spiral feeder having a spiral groove formed around an axis thereof.

4. The toner cartridge as defined in claim 1, which includes an engagement member adapted to allow said cartridge body to be held by said image forming apparatus in a latched manner when said toner cartridge body is attached to said image forming apparatus, and said shutter member is set in said open posture.

5. A toner cartridge adapted to be detachably attached to a given image forming apparatus, comprising:

a cartridge body for supplying toner to a development device incorporated in said image forming apparatus, through a toner supply port;

a shutter member adapted to be changed in posture between an open posture for opening said toner supply port and a closed posture for closing said toner supply port;

a manual operation lever adapted to be manually operated so as to change the posture of said shutter member; and a postural-change restriction mechanism for restricting a postural change of said shutter member set in said closed posture to said open posture, said postural-change restriction mechanism including:

a lock protrusion convexedly formed in either one of said manual operation lever and said cartridge body; and a blocking element integral with the other one of said operation lever and said cartridge body, said blocking element comprises a lock groove adapted to allow said lock protrusion to be fitted thereinto, said manual operation lever being operative to set said shutter member in said closed posture so as to block a postural change of said shutter member, and to be elastically deformed out of engagement with said lock protrusion when said cartridge body is attached to said image forming apparatus to allow the postural change of said shutter member to said open posture.

6. The toner cartridge as defined in claim 5, wherein:

said shutter member has a cylindrical body which includes:

a toner delivery opening formed in one end of said cylindrical body at a position capable of being opposed to said toner supply port;

a toner receiving opening formed in the other end of said cylindrical body at a position diagonal relative to said toner delivery opening and adapted to receive toner from said cartridge body to an inner space of said cylindrical body; and toner transport means adapted to be rotated in concentric relation to said cylindrical body so as to transport toner from said toner receiving opening to said toner delivery opening.

7. The toner cartridge as defined in claim 5, wherein said toner transport means comprises a spiral feeder having a spiral groove formed around an axis thereof.

8. The toner cartridge as defined in claim 5, which includes an engagement member adapted to allow said cartridge body to be held by said image forming apparatus in a latched manner when said toner cartridge body is attached to said image forming apparatus, and said shutter member is set in said open posture.

* * * * *

UNITED STATES PATENT AND TRADEMARK OFFICE

CERTIFICATE OF CORRECTION

PATENT NO. : 7,421,234 B2
APPLICATION NO. : 11/343173
DATED : September 2, 2008
INVENTOR(S) : Masami Ikeda and Chisato Hatakeyama It is certified that error appears in the above-identified patent and that said Letters Patent is hereby corrected as shown below:

On the title page, item [75] should read
-- (75) Inventors: Masami Ikeda, Osaka (JP);
Chisato Hatakeyama, Osaka (JP) --.

Signed and Sealed this

Third Day of February, 2009

JOHN DOLL
*Acting Director of the United States Patent and Trademark Office*